US006848358B1

(12) United States Patent
Viljanmaa

(10) Patent No.: US 6,848,358 B1
(45) Date of Patent: Feb. 1, 2005

(54) CALENDER

(75) Inventor: Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 19 days.

(21) Appl. No.: 10/088,459

(22) PCT Filed: Sep. 21, 2000

(86) PCT No.: PCT/FI00/00809

§ 371 (c)(1),
(2), (4) Date: Mar. 15, 2002

(87) PCT Pub. No.: WO01/23667

PCT Pub. Date: Apr. 5, 2001

(30) Foreign Application Priority Data

Sep. 24, 1999 (FI) ..... 19992057

(51) Int. Cl.[7] ..... B30B 3/00
(52) U.S. Cl. ..... 100/170; 100/163 R; 100/171
(58) Field of Search ..... 100/162 R, 163 R, 100/168, 169, 170 OR, 171, 176

(56) References Cited

U.S. PATENT DOCUMENTS

| | | | | | |
|---|---|---|---|---|---|
| 3,884,141 A | * | 5/1975 | Lehmann | 100/163 R |
| 4,266,475 A | * | 5/1981 | Lamon et al. | 100/168 |
| 4,501,197 A | * | 2/1985 | Karr et al. | 100/35 |
| 4,510,859 A | * | 4/1985 | Berry | 100/35 |
| 4,817,407 A | | 4/1989 | Alich | 72/8 |
| 4,823,690 A | * | 4/1989 | Stotz | 100/163 A |
| 5,438,920 A | | 8/1995 | Koivukunnas et al. | 100/38 |
| 5,662,037 A | * | 9/1997 | van Haag | 100/331 |
| 5,988,055 A | * | 11/1999 | Cramer | 100/163 R |

FOREIGN PATENT DOCUMENTS

| | | | |
|---|---|---|---|
| DE | 1150272 | 6/1963 | |
| EP | 0 242 783 | 10/1987 | D21G/1/00 |

* cited by examiner

*Primary Examiner*—Allen Ostrager
*Assistant Examiner*—Shelley Self
(74) *Attorney, Agent, or Firm*—Cohen, Pontani, Lieberman & Pavane

(57) ABSTRACT

To present invention relates to a calender for calendering a moving web of paper or board, the calender comprising a top roll (1) and a bottom roll (1) and a bottom roll (2), both of the rolls being of the variable-crown type, at least one intermediate roll (3) of an intermediate roll stack adapted between the top roll (1) and the bottom roll (2) in a disposition allowing the superimposed rolls (1, 2, 3) of the stack to be brought into a nip contact with each other during calendering, and support means (4, 5) for mounting the rolls (1, 2, 3) to the frame (6) of the calender or, alternatively, to guides (7) mounted on the frame (6). Actuator means (9, 19) are adapted between the mounts (5) of the superimposed rolls (1, 2, 3) forming the nips and/or between the bearing blocks (4) of the rolls so as to accomplish the relief of nip loading imposed by the weight of the intermediate rolls (3) and the auxiliary means connected thereto.

45 Claims, 5 Drawing Sheets

CALENDER

This is a national stage of PCT application No. PCT/F100/00809, filed on Sep. 21, 2000. Priority is claimed on that application, and on patent application Ser. No. 19/992,057 filed in Finland on Sep. 24, 1999.

FIELD OF THE INVENTION

The present invention relates to a calender for calendering a web of paper or board.

BACKGROUND OF THE INVENTION

Conventionally, the surface of a moving web of paper or board is smoothed and made glossy in a multiroll calender comprising a plurality of rolls stacked in a calender frame so as to form a nip contact with each other. The roll stack comprises a top roll and a bottom roll with at least one intermediate roll located therebetween. The rolls of the stack are compressed against each other by the top and bottom rolls that act as the loading rolls or, simply, by the bottom roll to provide a sufficiently high linear nip force. In calendering, the web passes through the calender nips formed by the superimposed rolls.

The rolls of the calender stack are mounted rotatably in bearing blocks that are usually attached to roll mounts. The roll mounts themselves are slidably connected to vertical guides adapted to the calender frame. In a conventional supercalender, the roll mounts are additionally connected to vertical screw jack assemblies adapted to the calender frame. When the roll stack is open, the positioning of the roll mounts in the vertical direction is accomplished by means of the jack assemblies comprising threaded screw rods and nuts running thereon. As each one of the mounts of the roll bearings rest on these jack nuts, the entire weight of the set of rolls is supported on the screw rods when the roll stack is unloaded. Bearing blocks of roll stack and thereby the rolls mounted thereon can be moved vertically in regard to the mounts.

The roll set of a multiroll calender has a plurality of rolls in a superimposed disposition, whereby the linear load imposed on the nips by the weights of the rolls increases nip-by-nip from the top nip to bottom nip, whereby the linear load in the bottom nip is the maximum stress imposed by the calender on the web passing the calender. Hence, the calender must be designed based on the load-bearing ability of the bottom nip, whereby a substantial portion of the potential calendering capacity of the upper nips remains unused. Also the weights of the roll bearing blocks and auxiliary devices connected thereto cause distortion in the linear pressure profiles of the nips, particularly at the nip ends, thus deteriorating the quality of the calendered web.

One technique developed for equalizing the nip loading is the so-called variable-crown calender, wherein the weights of the intermediate rolls do not essentially contribute to the linear load in the nips. In calenders equipped with variable-crown roll, the intermediate rolls of the stack are provided with load-relieving devices such as hydraulic load-relief cylinders or pivotal links connected to the calender frame, by means of which arrangements the linear load imposed by the intermediate rolls and auxiliary devices connected thereto can be relieved, thus allowing the nips to be loaded mainly by the variable-crown top and bottom rolls or, alternatively, an external load imposed on said rolls. In a load-relief system for the intermediate rolls, the design factors to be taken into account are the deflection stiffness, mass, shape and material properties of each roll. The support forces to be imposed on the intermediate rolls are varied with the help of the load-relief means so that the roll set is equilibrated and brought to a desired state of crowning. Variable-crown calenders are described, among other things, in U.S. Pat. No. 5,438,920.

SUMMARY OF THE INVENTION

It is an object of the present invention to provide an entirely novel type of calender construction capable of relieving the linear loads imposed on the calender nips by the weights of the roll masses.

The goal of the invention is achieved by way of disposing actuator means such as springs and/or hydraulic cylinders between the mounts of each superimposed pair of rolls so as to relieve the linear load of the nips. Within the constraints of available space, the actuator means may also be placed between the bearing blocks of two superimposed rolls forming a nip. If so needed, the cylinder portion of the hydraulic cylinder and the hydraulic fluid channels may be machined into the interior of the bearing blocks or their mounts.

The invention offers significant benefits.

In a calender according to the invention, the linear load of the nips may be relieved, whereby the loading imposed by the upper nips on the web can be increased, thus achieving a higher calendering capacity and improved quality of web calendering. A calender implemented according to the invention has a simple construction. For instance, it needs no threaded screws and nuts conventionally used in the position adjustment jacks of rolls inasmuch the rolls are separated from each other with the help of actuator means so that the rolls are displaced apart from each other by the distance of the quick-opening gap when the roll stack is unloaded. As the loading of nips can be relieved individually, the web being calendered can be treated single-sidedly by loading, e.g., the top and bottom rolls of a reversing nip by unequal forces. Furthermore, existing calenders can be readily and cost-efficiently modernized into a calender according to the invention.

Other objects and features of the present invention will become apparent from the following detailed description considered in conjunction with the accompanying drawings. It is to be understood, however, that the drawings are intended solely for purposes of illustration and not as a definition of the limits of the invention; for which reference should be made to the appended claims.

BRIEF DESCRIPTION OF THE DRAWINGS

In the following, the invention will be examined in more detail by making reference to the appended drawings.

DETAILED DESCRIPTION OF THE PRESENTLY PREFERRED EMBODIMENTS

Figure 1:
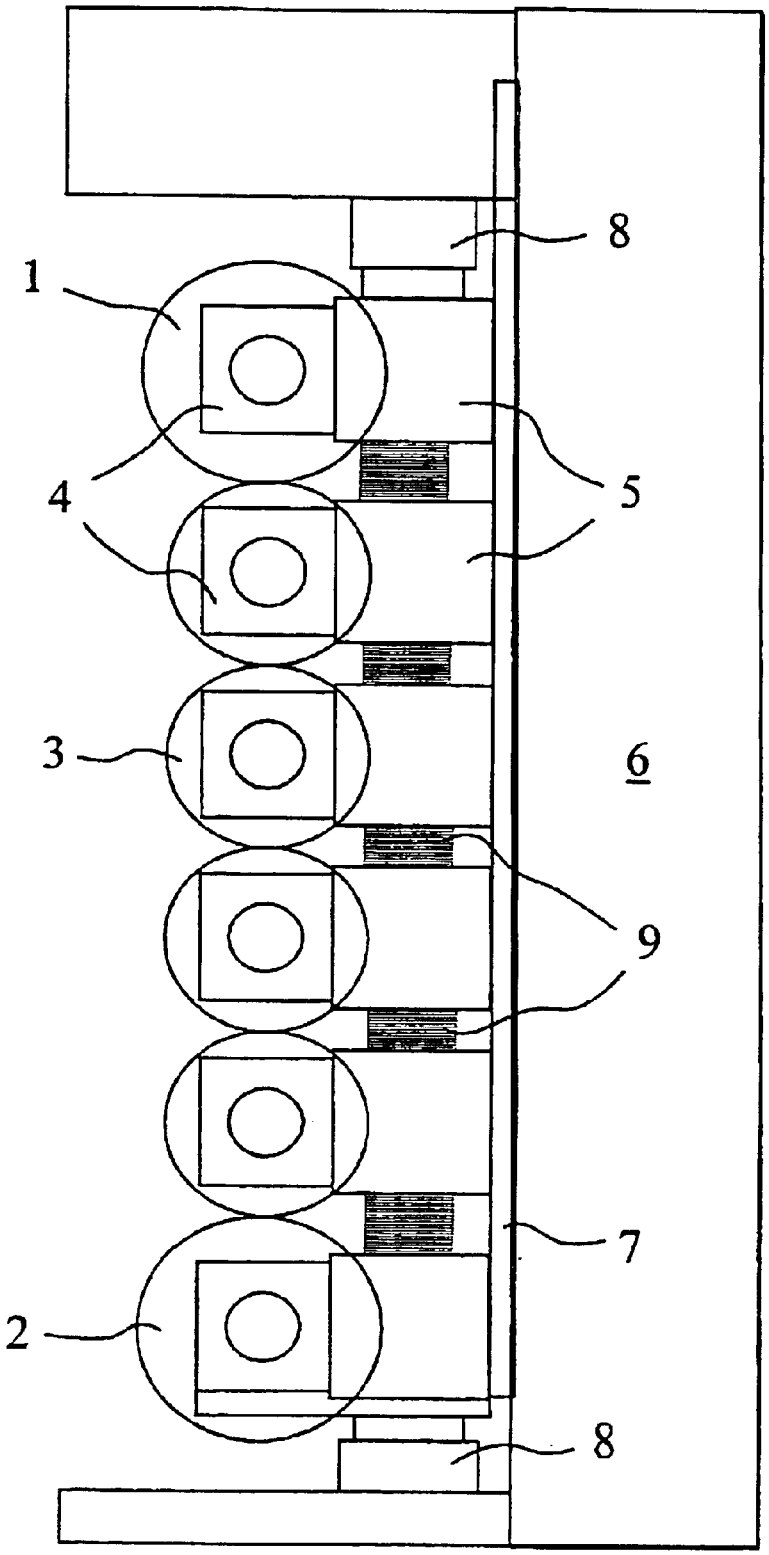
FIG. 1 shows diagrammatically a calender according to a preferred embodiment of the invention.

Referring to FIG. 1, the calender construction shown therein comprises a top roll 1 and a variable-crown bottom roll 2 having therebetween adapted intermediate rolls 3 of an intermediate roll set. The number of the intermediate rolls 3 is at least one. The rolls 1, 2, 3 are mounted on bearing blocks 4 that are further connected to mounts 5. The mounts 5 are slidably connected to guides 7 adapted on the calender frame 6. The roll set is moved and the load pressures of the nips formed between the rolls 1, 2, 3 is adjusted with the help of actuators such as loading cylinders 8 adapted to the calender frame 6 so as to impose the loading forces on the top roll 1 and the bottom roll 2. During calendering, the web passes the nips formed by the superimposed rolls.

Figure 4:
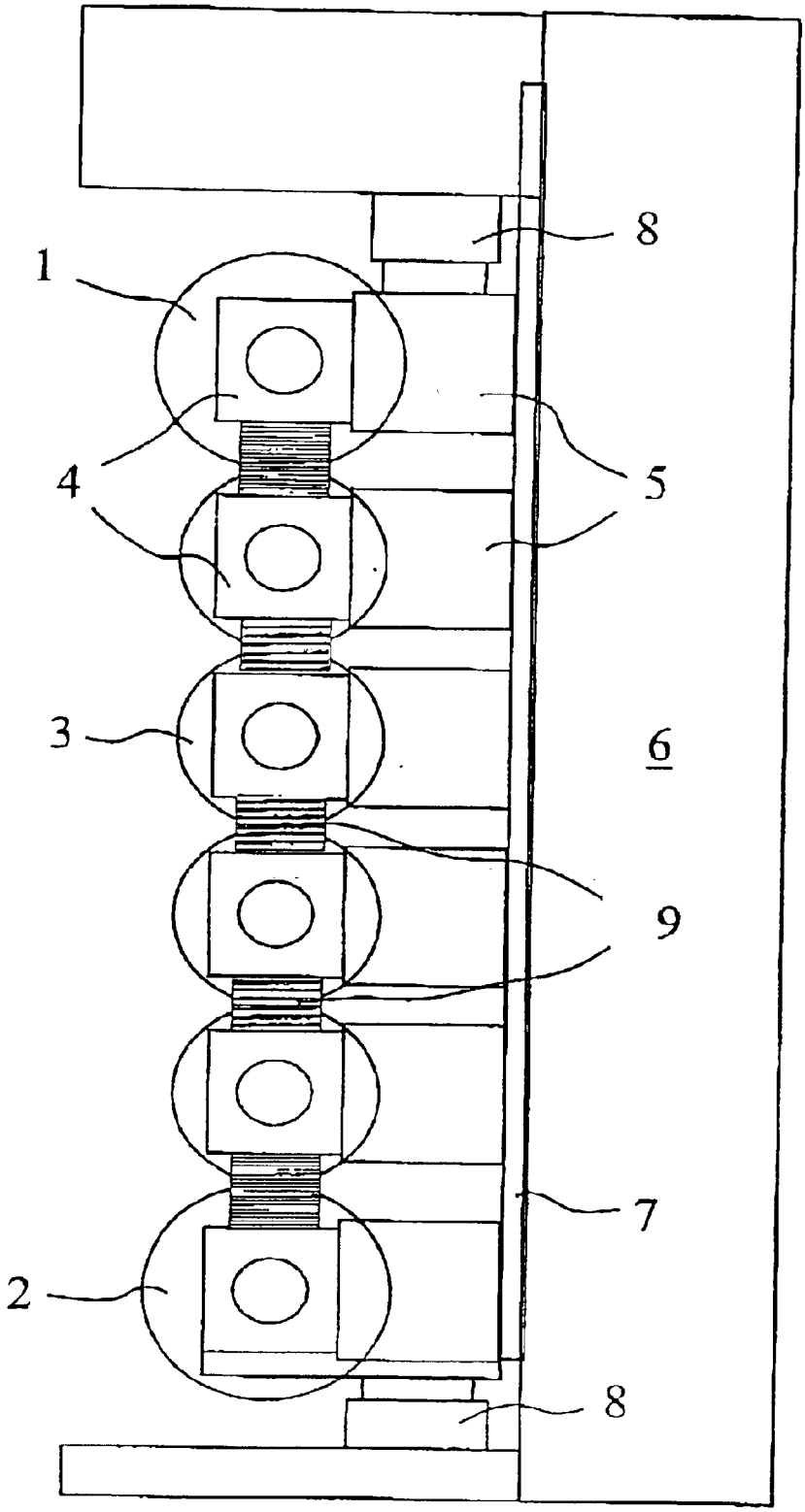
FIG. 4 shows diagrammatically still another calender according to a preferred embodiment of the invention.

Between the mounts 5 of the rolls forming the nip between two superimposed rolls, there are provided springs 9 such as a stack of cup springs, acting as actuators so as to relieve the linear loading of the nips caused by the weights of the rolls and the auxiliary devices connected thereto. Provided that a sufficient operating space is available, the springs 9 may alternatively be placed between the bearing blocks 4 of superimposed rolls forming a nip as is shown in FIG. 4. If a complete elimination of the linear loading caused by the rolls and their auxiliary devices on the nips is desirable, the springs 9 must be dimensioned so that their spring constant and length or, alternatively, the number of cup springs in a single stack of cup springs is selected such that the spring system 9 adapted between each mount 5 and/or bearing block 4 can support the weight of its overlying rolls and their auxiliary devices. Then, the spring constants are selected such that the spring system located between the mounts 5 of rolls 2, 3 forming the bottom nip has the highest spring constant, while the spring system located between the mounts 5 of rolls 1, 3 forming the top nip is selected to have the lowest spring constant. When the rolls 1, 2, 3 are not loaded by the loading cylinders 8, the springs 9 keep the rolls 1, 2, 3 separated at a distance of the quick-opening gap from each other. Additionally, the springs 9 must have some degree of overcompressibility to prevent them from bottoming during the loading of the roll set.

To keep the loading of the nips maximally equal, the springs 9 must be dimensioned so as to make all the nips to close simultaneously when loading is applied on the nips. Hence, the springs 9 of a smaller spring constant placed between the mounts 5 of the rolls forming the upper nips must respectively have a longer working travel. Alternatively, the system can be constructed using progressive springs in which the spring constant changes with the travel.

The quick-opening of the calender nips is accomplished by way of removing the loading imposed by the loading cylinders 8, whereby the springs 9 placed between the mounts 5 can separate the rolls 1, 2, 3 apart from each other. The gap width of the quick-opened nips can be changed by, e.g., varying the number of cup springs in the assembled spring stack.

Figure 2:
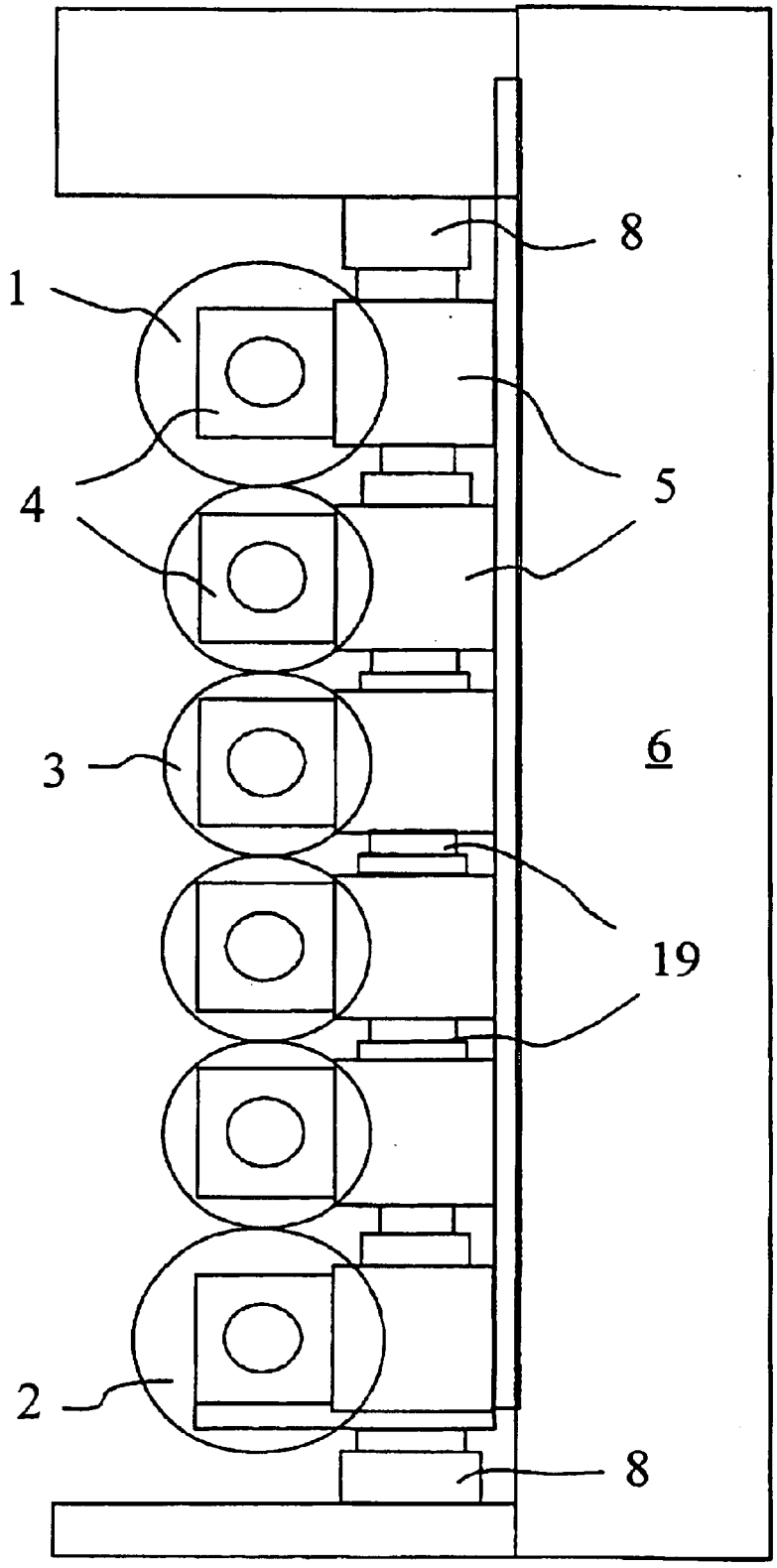
FIG. 2 shows diagrammatically another calender according to a preferred embodiment of the invention.
Figure 3:
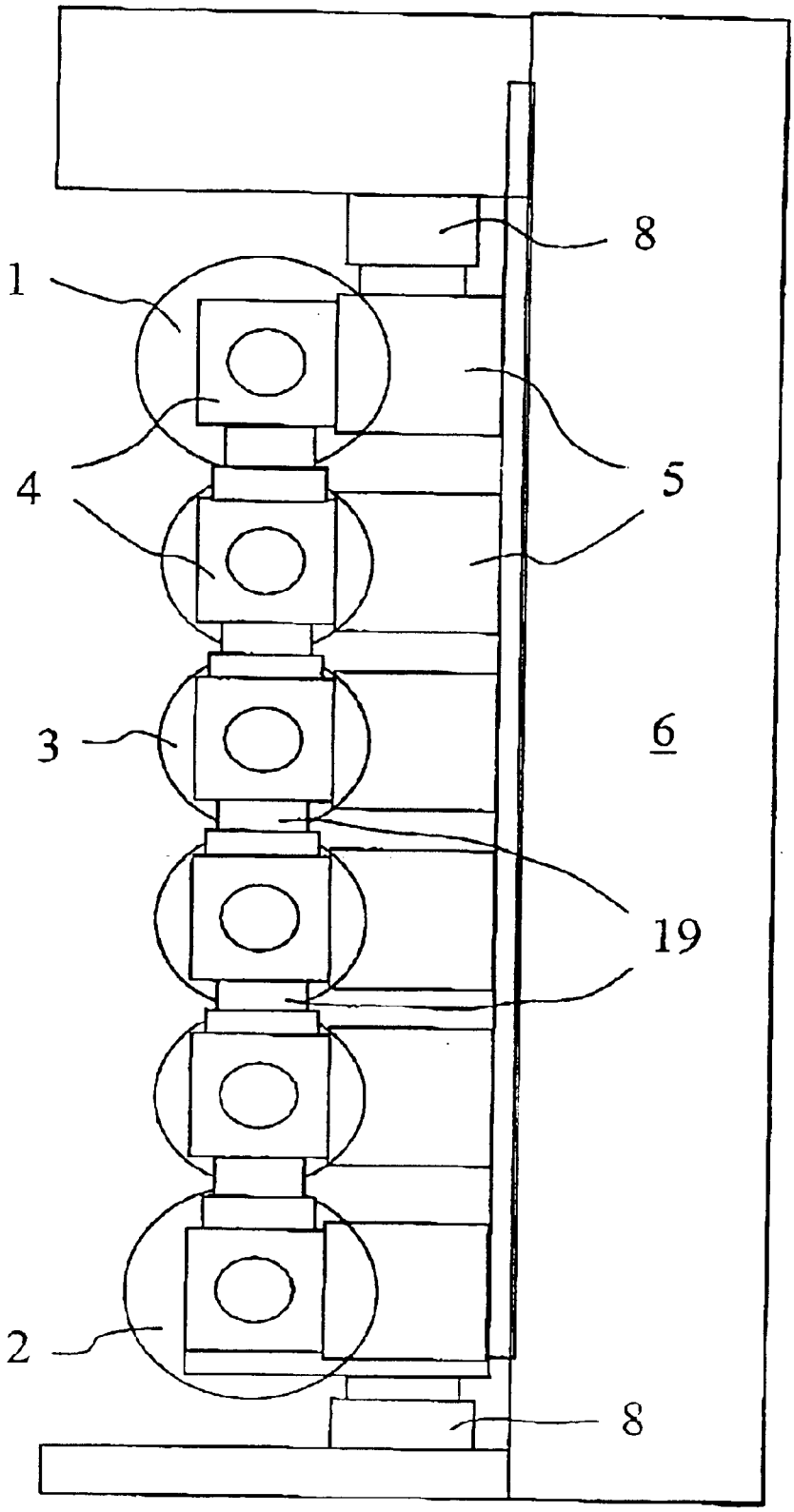
FIG. 3 shows diagrammatically yet another calender according to a preferred embodiment of the invention.

In the embodiment of FIG. 2, there are no springs 9 located between the mounts 5 of the rolls forming a nip, but rather, hydraulic cylinders 19 are used as the actuator means. Herein, the gap width of the quick-opened nips and the nip loading forces can be adjusted with the help of the hydraulic cylinders 19 by means of changing the pressure of the hydraulic fluid. Otherwise the embodiment of FIG. 2 is basically identical to that shown in FIG. 1. Also, as shown in FIG. 3, the hydraulic cylinders 19 may be located, within the space constraints, between the bearing blocks 4 of superimposed rolls 1, 2, 3 forming a nip. To save space, the cylinder portion of the hydraulic cylinder 19 and the hydraulic fluid channels communicating therewith may be machined directly into the interior of the mounts 5 or the bearing blocks 4.

Figure 5:
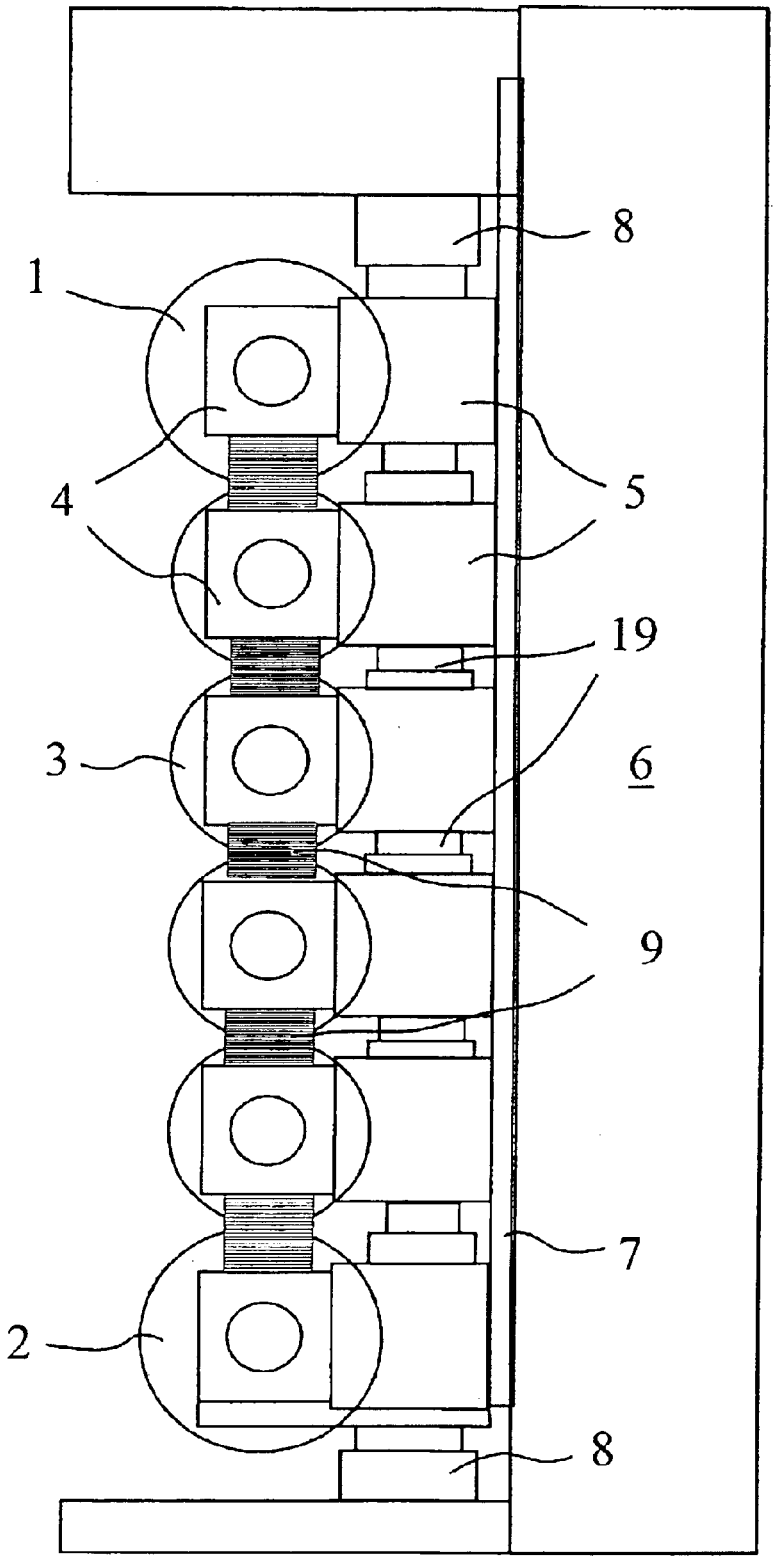
FIG. 5 shows diagrammatically yet a further calender according to a preferred embodiment of the invention.

In addition to those described above, the invention may have alternative embodiments. For example, a calender according to the present invention may use a combination of springs and hydraulic cylinders as actuator means. FIG. 5 shows a calender where an exemplary combination of springs 9 between bearing blocks 4 and hydraulic cylinders 19 between mounts 5 is used as the actuator means. Furthermore, the actuator means may be implemented in other ways besides springs and/or hydraulic cylinders, which are only examples of means to relieve the linear load of the nibs.

When necessary, the loading of certain nips may be relieved by a greater amount than the loading of certain others, whereby it is possible within the constraints of the allowable deflections of rolls 1, 2, 3 to affect the degree of single-sidedness of the calendered web.

The top roll 1 and/or the bottom roll 2 may be connected by their bearing blocks 4 to the guides 7, rather than by their mounts as taught above. The top roll 1 or the bottom roll 2 of the calender can be solidly connected by its mounts 5 or bearing blocks 4 to the calender frame 6 or its guides 7. In this arrangement, the fixed rolls 1, 2 need not be provided with loading cylinders 8, but rather, the entire roll set of the stack can be simply loaded with the help of the loading cylinders 8 acting on the other roll 1, 2 adapted movable along the guides 7.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A calender for calendering a web of paper or board comprising a top variable-crown roll;

a bottom variable-crown roll;

at least one intermediate roll positioned between said top roll and said bottom roll, wherein said top roll, said bottom roll and said at least one intermediate roll are disposed in a vertical stack such that the rolls may be brought into nip contact with adjacent rolls to form a nip during calendering;

bearing blocks in which said rolls are mounted;

a frame;

mounts to which said bearing blocks of said at least one intermediate roll are connected, wherein said mounts of said at least one intermediate roll are slidably connected to guides in said frame; and a plurality of actuator means, wherein each of said plural actuator means is positioned between at least one of said mounts and said bearing blocks of two adjacent rolls, wherein each of said actuator means is individually adapted to substantially relieve the specific linear loading of the nip between said adjacent rolls caused by the weight of the rolls, bearing blocks, mounts, and any other actuator means located above the actuator means in said vertical stack.

2. The calender of claim 1, wherein at least one of said plural actuator means comprises a spring.

3. The calender of claim 1, wherein at least one of said plural actuator means comprises a hydraulic cylinder.

4. The calender of claim 1, wherein said plural actuator means comprises at least one spring and at least one hydraulic cylinder.

5. The calender of claim 1, wherein each of said plural actuator means is positioned between said mounts of said adjacent rolls.

6. The calender of claim 2, wherein each of said plural actuator means is positioned between said mounts of said adjacent rolls.

7. The calender of claim 3, wherein each of said plural actuator means is positioned between said mounts of said adjacent rolls.

8. The calender of claim 4, wherein each of said plural actuator means is positioned between said mounts of said adjacent rolls.

9. The calender of claim 1, wherein each of said plural actuator means is positioned between said bearing blocks of said adjacent rolls.

10. The calender of claim 2, wherein each of said plural actuator means is positioned between said bearing blocks of said adjacent rolls.

11. The calender of claim 3, wherein each of said plural actuator means is positioned between said bearing blocks of said adjacent rolls.

12. The calender of claim 4, wherein each of said plural actuator means is positioned between said bearing blocks of said adjacent rolls.

13. The calender of claim 1, wherein said plural actuator means are located between said bearing blocks and said mounts of said adjacent rolls.

14. The calender of claim 2, wherein said plural actuator means are located between said bearing blocks and said mounts of said adjacent rolls.

15. The calender of claim 3, wherein said plural actuator means are located between said bearing blocks and said mounts of said adjacent rolls.

16. The calender of claim 4, wherein said plural actuator means are located between said bearing blocks and said mounts of said adjacent rolls.

17. The calender of claim 3, wherein a cylinder portion of said at least one hydraulic cylinder and any hydraulic channels thereof are formed in said mounts.

18. The calender of claim 4, wherein a cylinder portion of said at least one hydraulic cylinder and any hydraulic channels thereof are formed in said mounts.

19. The calender of claim 3, wherein a cylinder portion of said at least one hydraulic cylinder and any hydraulic channels thereof are formed in said bearing blocks.

20. The calender of claim 4, wherein a cylinder portion of said at least one hydraulic cylinder and any hydraulic channels thereof are formed in said bearing blocks.

21. The calender of claim 3, wherein a cylinder portion of said at least one hydraulic cylinder and any hydraulic channels thereof are formed in said mounts and said bearing blocks.

22. The calender of claim 4, wherein a cylinder portion of said at least one hydraulic cylinder and any hydraulic channels thereof are formed in said mounts and said bearing blocks.

23. A method for calendering a web of paper or board comprising the steps of:

passing a web to be calendered via nips formed by a top variable-crown roll, a bottom variable-crown roll, and at least one intermediate roll positioned between said top roll and said bottom roll, wherein said top roll, said bottom roll and said at least one intermediate roll are disposed in a vertical stack such that the rolls may be brought into nip contact with adjacent rolls to form a nip during calendering, and wherein said rolls are mounted in bearing blocks, and the bearing blocks of the at least one intermediate roll are slidably connected to a frame by mounts; and relieving linear loading of a nip with an actuator means, wherein said actuator means is positioned between at least one of said mounts and said bearing blocks of the two adjacent rolls forming said nip, and wherein said actuator means is individually adapted to substantially relieve the specific linear loading caused by the weight of the rolls, bearing blocks, the mounts, and any other actuator means located above said actuator means in said vertical stack.

24. The calender of claim 1, wherein a bearing block of at least one of the top or the bottom variable-crown roll is either solidly connected to the frame or slidably connected to the guides in the frame.

25. The calender of claim 1, further comprising:

a mount to which the bearing block of either the top or the bottom variable-crown roll is connected.

26. The calender of claim 25, wherein the mount of either the top or the bottom variable-crown roll is either solidly connected to the frame or slidably connected to the guides in the frame.

27. The calender of claim 1, further comprising:

a top loading cylinder connected to said frame and to either a bearing block or a mount of the top variable crown roll, wherein said top loading cylinder imposes loading forces on the top variable crown roll thereby helping to adjust the load pressures on the nips.

28. The calender of claim 1, further comprising:

a bottom loading cylinder connected to said frame and to either a bearing block or a mount of the bottom variable crown roll, wherein said bottom loading cylinder imposes loading forces on the bottom variable crown roll thereby helping to adjust the load pressures on the nips.

29. The calender of claim 1, further comprising:

a top loading cylinder connected to said frame and to either a bearing block or a mount of the top variable crown roll, wherein said top loading cylinder imposes loading forces on the top variable crown roll thereby helping to adjust the load pressures on the nips; and a bottom loading cylinder connected to said frame and to either a bearing block or a mount of the bottom variable crown roll, wherein said bottom loading cylinder imposes loading forces on the bottom variable crown roll thereby helping to adjust the load pressures on the nips.

30. The calender of claim 2, wherein at least one of the spring constant and the length of said spring is selected such that said spring can support the weight of the rolls, bearing blocks, mounts, and any other actuator means located above said spring in said vertical stack.

31. The calender of claim 2, wherein said spring comprises a stack of cup springs, wherein the number of cup springs in said stack of cup springs is selected such that said stack of cup springs can support the weight of the rolls, bearing blocks, mounts, and any other actuator means located above said stack of cup springs in said vertical stack.

32. The calender of claim 1, wherein said plurality of actuator means comprises:

a top spring positioned between said top variable-crown roll and an intermediate roll adjacent to said variable-crown roll in said vertical stack;

at least one intermediate spring positioned between two adjacent intermediate rolls in said vertical stack; and a bottom spring positioned between said bottom variable-crown roll and an intermediate roll adjacent to said bottom variable-crown roll in said vertical stack;

wherein said top, at least one intermediate, and bottom springs are constructed such that each spring can support the weight of the rolls, bearing blocks, mounts, and any other springs located above said spring in said vertical stack.

33. The calender of claim 32, wherein at least one of the spring constant and the length of each of the springs is adapted so that each spring can support the weight of the rolls, bearing blocks, mounts, and any other springs located above said spring in said vertical stack.

34. The calender of claim 33, wherein the spring constants of the springs vary inversely with the height of each spring within said vertical stack, such that said bottom spring has the highest spring constant and said top spring has the lowest spring constant.

35. The calender of claim 33, wherein the dimensions of the springs vary directly with each spring's height within said vertical stack, such that said bottom spring has the shortest working travel and said top spring has the highest working travel.

36. The calender of claim 33, wherein each of said top, at least one intermediate, and bottom springs is constructed using progressive springs in which the spring constant changes with the travel.

37. The calender of claim 33, wherein each of said top, at least one intermediate, and bottom springs is dimensioned so as to make all the nips close simultaneously when loading is applied.

38. The calender of claim 33, wherein each of said top, at least one intermediate, and bottom springs has some degree of overcompressibility to prevent them from bottoming during loading.

39. The calender of claim 32, wherein at least one spring of said top, at least one intermediate, and bottom springs comprises a stack of cup springs, wherein the number of cup springs in said stack of cup springs is selected such that said stack of cup springs can support the weight of the rolls, bearing blocks, mounts, and any other springs located above said stack of cup springs in said vertical stack.

40. The method of claim 23, further comprising the step of:

quickly opening at least one calender nip by removing loading imposed by a loading cylinder, wherein said loading cylinder is connected to said frame and to either a bearing block or a mount of one of the top variable-crown roll or the bottom variable crown roll.

41. The method of claim 40, wherein all calender nips are opened in said step of quickly opening at least one calender nip.

42. The method of claim 23, further comprising the step of:

quickly opening at least one calender nip by removing loading imposed by at least one of a top loading cylinder and a bottom loading cylinder, wherein said top loading cylinder is connected to said frame and to either a bearing block or a mount of the top variable crown roll and said bottom loading cylinder is connected to said frame and to either a bearing block or a mount of the bottom variable crown roll.

43. The method of claim 42, wherein all calender nips are opened in said step of quickly opening at least one calender nip.

44. A method for calendering a web of paper or board comprising the steps of:

passing a web to be calendered via calender nips formed by a top variable-crown roll, a bottom variable-crown roll, and at least one intermediate roll positioned between said top roll and said bottom roll, wherein said tot roll, said bottom roll and said at least one intermediate roll are disposed in a vertical stack such that the rolls may be brought into contact with adjacent rolls to form calender nips during calendering, and wherein said rolls are mounted in bearing blocks, and the bearing blocks of the at least one intermediate roll are slidably connected to a frame by mounts, and affecting a degree of single-sidedness of the calendered web by relieving linear loading of at least one calender nip by a greater amount than the loading of at least one other calender nip with an actuator means, wherein said linear loading is caused by the weight of the rolls and auxiliary means located above said actuator means in said vertical stack, wherein said actuator means is positioned between at least one of said mounts and said bearing blocks of the two adjacent rolls forming said at least one calender nip, and wherein said auxiliary means comprises the bearing blocks, the mounts and any other actuator means.

45. The method of claim 23, further comprising the step of:

affecting a degree of single-sideness of the calendered web by relieving the loading of at least one calender nip by a greater amount than the loading of at least one other calender nip.

* * * * *